US005497425A

United States Patent [19]

Rapoport

[11] Patent Number: 5,497,425

[45] Date of Patent: Mar. 5, 1996

[54] MULTI CHANNEL SURROUND SOUND SIMULATION DEVICE

[76] Inventor: Robert J. Rapoport, 3900 46th Ave. S., St. Petersburg, Fla. 33711

[21] Appl. No.: 207,282

[22] Filed: Mar. 7, 1994

[51] Int. Cl.[6] ..... H04R 5/00

[52] U.S. Cl. ..... 381/18; 381/1; 381/17; 381/24

[58] Field of Search ..... 381/18, 24, 1, 381/17, 19, 27, 28, 10, 22, 23

[56] References Cited

U.S. PATENT DOCUMENTS

| | | | |
|---|---|---|---|
| 3,697,692 | 10/1972 | Hafler | 179/1 |
| 4,433,209 | 2/1984 | Kurosawa et al. | 381/1 |
| 4,589,129 | 5/1986 | Blackmer et al. | 381/18 |
| 4,887,298 | 12/1989 | Haigler | 381/96 |
| 4,908,876 | 3/1990 | Nagi | 381/96 |
| 4,953,213 | 8/1990 | Tasaki et al. | 381/24 |
| 4,984,273 | 1/1991 | Aylward et al. | 381/1 |
| 5,136,650 | 8/1992 | Griesinger | 381/24 |
| 5,265,166 | 11/1993 | Madnick et al. | 381/27 |

OTHER PUBLICATIONS

Installation News, vol. 5, No. 8, Jun. 8, 1988.

*Primary Examiner*—Curtis Kuntz
*Assistant Examiner*—Xu Mei
*Attorney, Agent, or Firm*—James E. Larson; Herbert W. Larson

[57] ABSTRACT

A passive multi channel surround sound simulation device has a pair of input jacks for receiving a two channel stereophonic signal having a speaker level. An electronic circuit produces from the two channel signal left and right primary speaker level outputs, left and right secondary speaker level outputs, a mono center line level output, left and right secondary line level outputs, and a surround ground separate from an input ground. First, second and third voltage dividers reduce the stereophonic signal speaker level to a line level of about 10% of that which appears at the left and right primary speaker level outputs, for directing to the mono line level output, and the left and right secondary line level outputs respectively. The left and right primary speaker level outputs are connected to left and right front speakers respectively. The left and right secondary speaker level outputs are connected to left and right rear speakers respectively. The mono center line level output is connected to a center speaker through an amplifier. The left and right secondary line level outputs allow connection to left and right rear speakers through further amplification.

20 Claims, 3 Drawing Sheets

MULTI CHANNEL SURROUND SOUND SIMULATION DEVICE

BACKGROUND OF THE INVENTION

1. Field of the Invention

This invention relates to a multi channel surround sound simulation device used for home theater applications. More particularly, it relates to a device for passively decoding a surround sound encoded two-channel stereophonic soundtrack into four separate audio channels and a discreet fifth or center channel.

2. Description of Prior Art

Surround sound technology is known in the art and, until recently, most commonly used on film soundtracks for theater presentations. The surround sound process involves encoding two stereophonic channels with multiple channels of audio information by mathematical manipulation of frequency and phase information. The two channel encoded audio information is then decoded through a surround sound processor and directed to a plurality of loudspeakers thereby presenting multiple channels of audio information to a listener. Proper speaker placement allows the listener to perceive audio signals emanating from the front, rear, or side depending on the speaker placement. The ideal speaker configuration employs left and right front speakers, left and right rear speakers, and a single center front speaker. A spatial or ambience perception of sound is perceived by the listener from the rear speakers wherein out of phase signals are present. The center channel is a mono combination of the two channel input signal and used to provide frontal localization of the sound source to remove the left-right perception of the two front channels.

The most well known surround sound mode is presented by Dolby Laboratories marketed under the trademark Dolby Surround Sound. Dolby encodes video and film soundtracks for active decoding of the soundtrack thereby delivering five discreet channels of audio. Other surround sound modes are known and commonly attempt to produce sounds to simulate various concert hall settings for audio listening usually delivering four separate channels of audio information.

Recently, surround sound technology has been introduced to the home theater market wherein surround sound information is encoded on video tapes and laserdiscs. This allows individuals to experience surround sound at home, as experienced in movie theater presentations. To experience surround sound, an individual must have a means of decoding the surround sound information from a given encoded stereophonic source. Since it would be impractical for home theater listeners to purchase the expensive equipment used in theater presentations, there is a need for inexpensive systems to decode surround sound information for the home theater market.

Many attempts have been made to decode surround sound information for the home theater market thereby delivering multiple channels of audio information to a plurality of loudspeakers. One such system is seen in U. S. Pat. No. 4,953,213 to Tasaki et al., wherein the system provides surround sound simulation by providing a surround sound decoding processor, a surround mode switch circuit, and four channels of power amplification. The four channels of amplification are located along the signal path intermediate the surround sound processor and the speakers. The surround mode switch circuit selectively diverts the signal path from a third and fourth amplifier, $2_3$ and $2_4$ respectively, to deliver power output to the two rear speakers and the center speaker; the center speaker only being active in the Dolby Surround Sound mode. Although the Tasaki et al. system successfully delivers surround sound information to a plurality of speakers, the system requires four channels of amplification which can be expensive for a home audio/video enthusiast. Further, Tasaki et al. is limited to using the four channels of amplification with four of five loudspeakers in the surround sound mode. The Tasaki et al. device is unable to operate with five, three, or two channels of amplification.

Another attempt to decode surround sound encoded audio information for deliverance to a plurality of loudspeakers is seen in U.S. Pat. No. 5,265,166 to Madnick et al. The Madnick et al. system is able to deliver audio information to either two, four, or five speakers depending on the surround mode being decoded. A switch allows a user of the system to switch between the different surround sound modes. The Madnick et al. system receives two channel surround sound encoded information from a two channel amplified signal source, produces the separate channels, and disperses the decoded surround sound information to two, four, or five loudspeakers, respectively. The Madnick et al. system delivers a speaker level output to all the output terminals for direct connection with the speakers; there are no line level outputs on the Madnick et al. system. Further, the Madnick et al. system includes an inhibiting circuit to reduce high frequency information from the two rear speaker and center speaker outputs The inhibiting circuit is located within the circuit of the system intermediate the signal source input and the speaker outputs of the surround sound system. This inhibiting circuit evolved from a need to reduce high frequency information from the rear and center channels from surround sound encoded video tapes and laserdiscs. When surround sound audio first appeared in the home market, the encoded soundtracks were transferred or "dubbed" directly from the film version shown in movie theaters to the video tape or laserdisc used for home presentation. The high frequency information in the rear and center channels of surround sound encoded film soundtracks are intentionally boosted for theater presentations to compensate for sound absorption by the movie screen, carpeting, and other similar absorbing materials found within a movie theater. Therefore, there was a need for an inhibiting circuit as seen in Madnick et al.

Recently however, the film industry has compensated for the boosted high frequency information present on film soundtracks by rolling off the high frequencies during the film to video tape and laserdisc transferring process. Therefore, the inhibiting circuit of Madnick et al. is moot. Further to Madnick et al., the four or five respective output channels are driven entirely by two channels of amplification. Although two channels of amplification minimizes expenses in the Madnick et al. system, it does not allow discreet channel separation of the four or five respective output channels. Amplitude changes of the rear and center speakers are directly proportional to each other. It is common for an individual listening to a surround sound presentation to desire to lower the amplitude of the rear channel information but not the center channel information. The Madnick et al. device does not allow for this separate control. Further, there are no line level outputs to introduce additional amplification to the rear or center speakers to separate amplitude control of rear and center channels. The "bleeding" of the two channel input to drive five separate speakers has led to inadequate power response and frequency loss, most significantly in the center speaker. Although systems as seen in Madnick et al. have been adequate for reproduction of conversational audio, it has not successfully reproduced musical audio as felt and heard in film theaters.

There exists a need for an improved surround sound device allowing for multiple configuration of separate amplitude control of surround sound decoded output channels. The improved surround sound device needs to have a means for converting the speaker level signal to a line level signal so that additional amplification can be introduced into the system. Further, the device needs to employ passive circuitry for this level conversion to avoid introducing noise to the stereophonic signal.

SUMMARY OF THE INVENTION

I have invented an improved surround sound decoding device for use with surround sound encoded video tapes, laserdiscs, and the like. My device is also useable with audio tapes, compact discs, and the like. The device allows for two to five channels of amplification connectable to two to five loudspeakers. My device has a passive means for converting the speaker level signal to a line level for output to additional amplification.

A two channel speaker level stereophonic signal source is connected to the surround sound device at left and right signal inputs. The signal source at the left signal input is directly output to a left front speaker output and the signal source at the right signal input is directly output to a right front speaker output. A summation of the voltage potential differences of each respective negative polarity signal input is directed to negative leads of left and right rear speaker outputs providing a new reference for the rear outputs, separate from the signal input reference. A positive lead of right signal input is directed to a positive lead of right rear speaker output and a positive lead of left signal input is directed to a positive lead of left rear output.

A first node on each positive lead of left and right signal input directs the signal thru a passive speaker level to line level convertor to a combined point thereby providing a line level mono signal to a single center line level output for connection with a center speaker through an additional channel of amplification. The passive conversion of the signal from speaker to line level reduces noise and distortion compared to an active conversion. A reference to ground is provided from the line level signal of the positive lead of the center output, separate from the input ground. An additional pair of rear speaker line level outputs is provided to allow separate amplification of the rear speakers. The line level signal appearing at the center line level output and rear line level outputs is about 10% of the speaker level signal seen at the left and right front speaker outputs.

My device further includes a gang potentiometer for adjusting the amplitude of the rear speaker outputs when connected to either the rear speaker level or line level outputs and the center output. A three position gang rotary switch is provided allowing the user to switch between front, rear, and theater mode, wherein the theater mode is the surround mode.

My surround sound device allows a user to perform four channel surround sound with two channels of amplification, five channels of surround sound with three channels of amplification, or five channels of surround sound with five channels of amplification. Still further, a user could direct the two rear line level outputs to an additional two channels of amplification while still using the speaker level rear outputs. Connection to the rear line level outputs does not open the circuit to the rear speaker level outputs.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
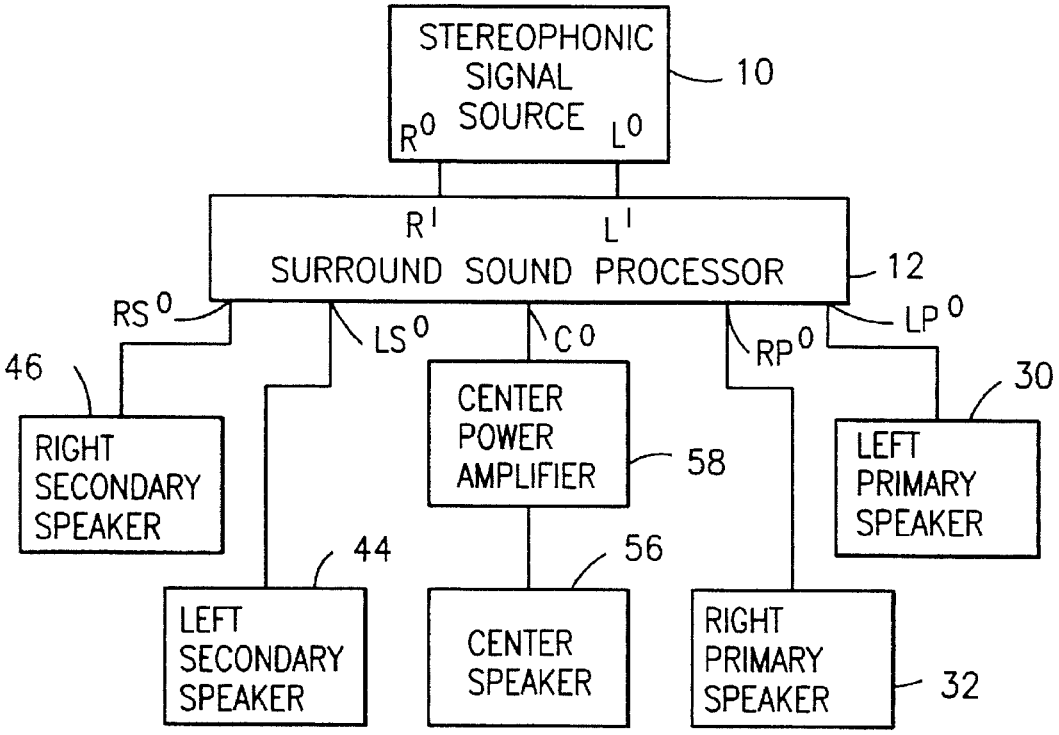
FIG. 1 is a block diagram of a multi channel surround sound simulation device of the present invention.

Throughout the following detailed description, the same reference numerals refer to the same elements in all figures.

Referring to FIG. 1 a stereophonic signal source 10 has left and right signal outputs, L° and R° respectively. The stereophonic signal source 10 is an amplified speaker level signal deriving from tape, disc, or other similar sound sources. A surround processor 12 has left and right signal inputs, $L^i$ and $R^i$ respectively, for receiving left and right signal outputs, L° and R° respectively, from stereophonic signal source 10.

Figure 2:
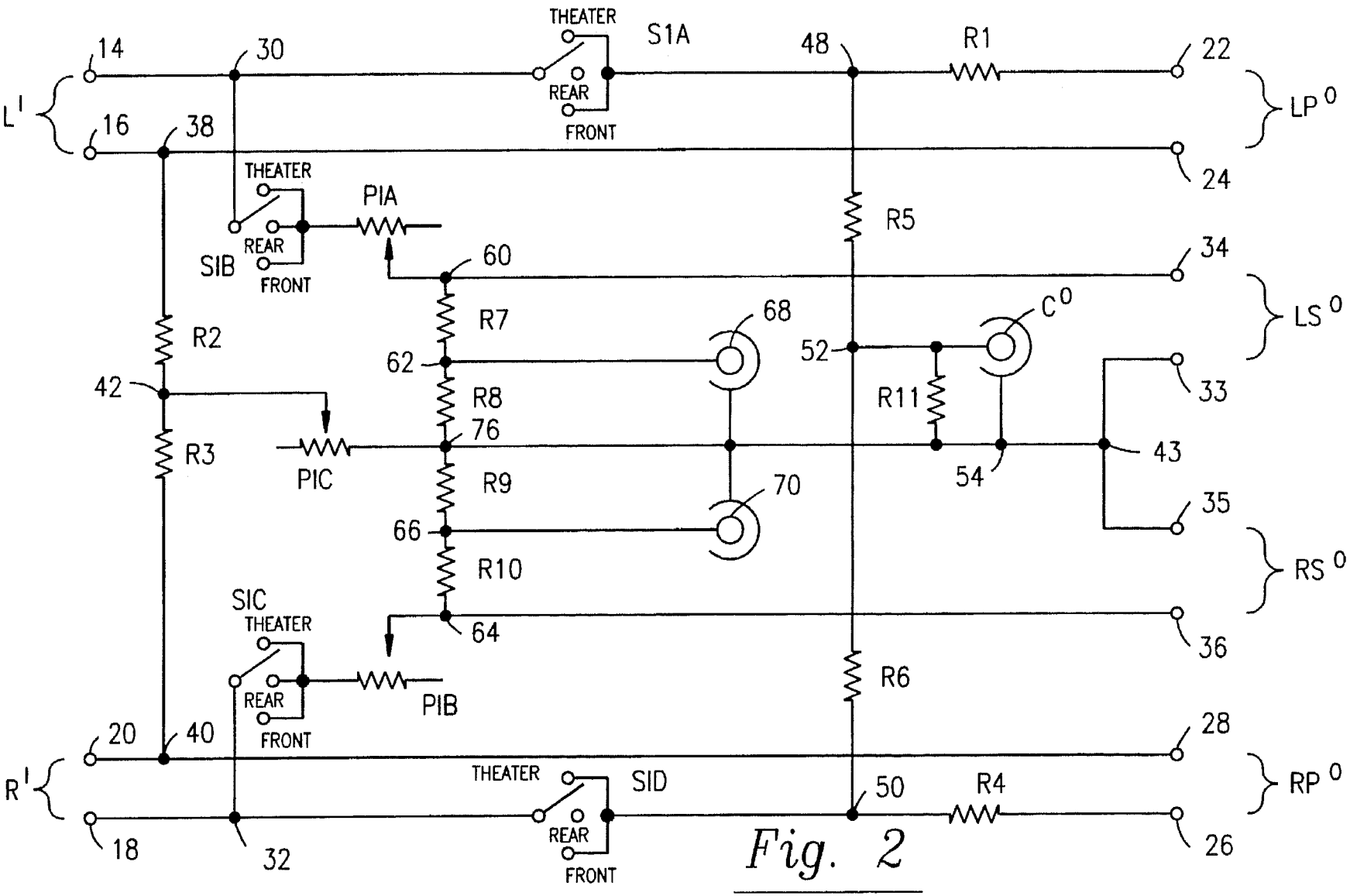
FIG. 2 is a schematic diagram of the circuit used in the multi channel surround sound simulation device of the present invention.
Figure 4:
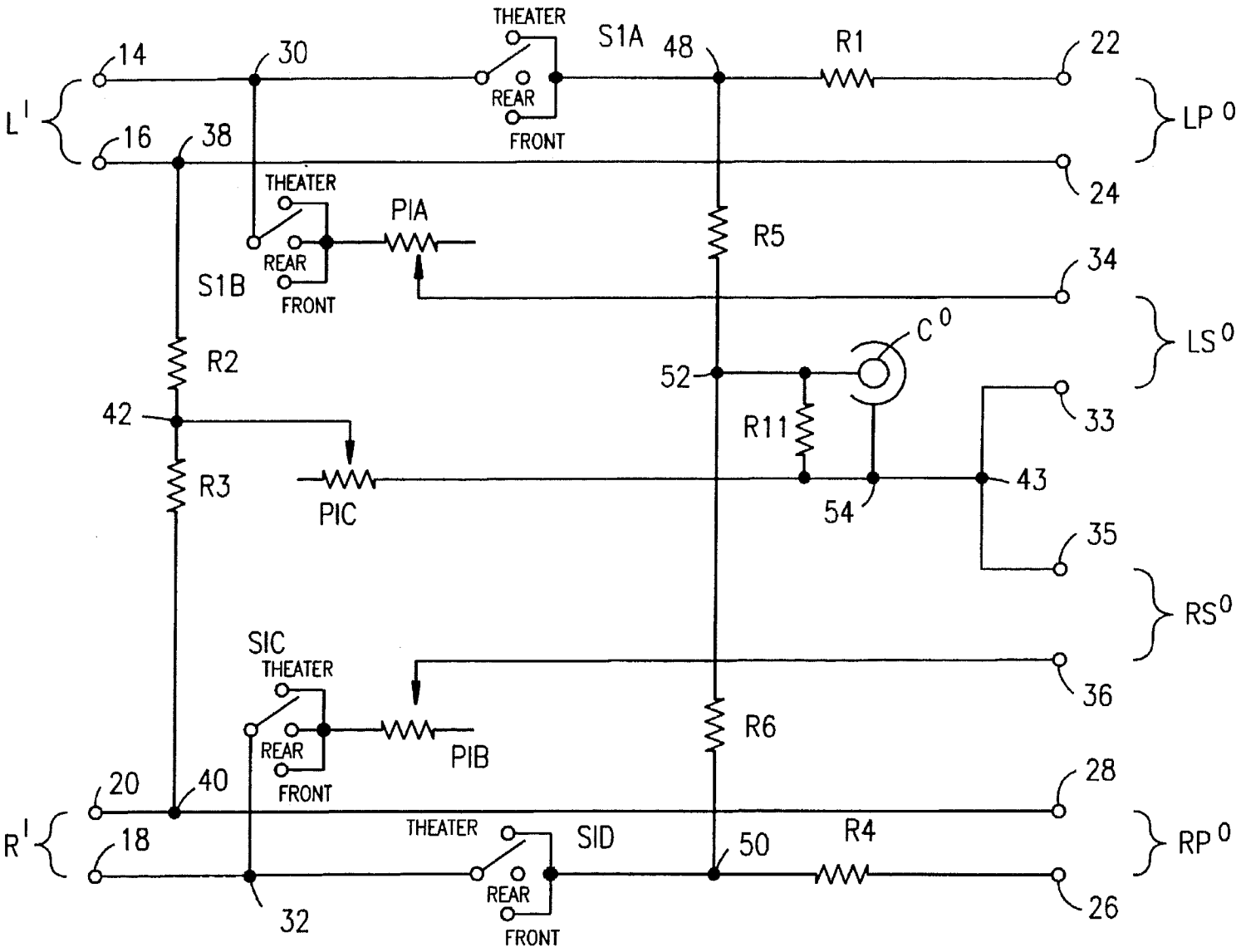
FIG. 4 is a schematic diagram of an alternate circuit used in the multi channel surround sound simulation device of the present invention.

Referring to FIG. 2, left signal input $L^i$ has a positive and negative terminal, 14 and 16 respectively, and right signal input $R^i$ has a positive and negative terminal, 18 and 20 respectively. The signal applied to positive terminal 14 and negative terminal 16 of left signal input $L^i$ is output to a positive terminal 22 and a negative terminal 24 respectively at a left primary output LP°. The signal applied to positive terminal 18 and negative terminal 20 of right signal input $R^i$ is output to a positive terminal 26 and a negative terminal 28 respectively at a right primary output RP°.

Referring to FIG. 1, left primary output LP° is connected to a left primary speaker 30 and right primary output RP° is connected to a right primary speaker 32 In the preferred embodiment, left primary speaker 30 represents left front speaker and right primary speaker 32 represents right front speaker. Further to the preferred embodiment, left signal input $L^i$, right signal input $R^i$ employ female RCA type jacks, and left primary output LP°, and right primary output RP° employ spring loaded terminals for their respective positive and negative leads.

Referring to FIG. 2, a resistor R1 is placed intermediate positive terminal 14 of left signal input $L^i$ and positive terminal 22 of left primary output LP°. A resistor R4 is placed intermediate positive terminal 18 of right signal input $R^i$ and positive terminal 26 of right primary output RP°. Accordingly, resistors R1 an R4 are wired in series with the load appearing at left primary output LP° and right primary output RP° respectively. Resistors R1 and R4 function to stabilize the input signal, maintaining a minimal amount of load across left primary output LP° and right primary output RP° to the amplifier (not shown) feeding the signal source 10. Resistors R1 an R4 can range in value from one to four ohms, although in the preferred embodiment, resistors R1 and R4 have a value of 2.2 ohms with a power rating of 10 watts, thereby maintaining a load of at least 2.2 ohms, regardless of the number of speakers connected to the sound processor 12.

Referring to FIG. 2, a node 30 directs the signal applied to positive terminal 14 to a positive terminal 34 of a left secondary output LS°. A node 32 directs the signal applied to positive terminal 18 to a positive terminal 36 of a right secondary output RS°. A node 38 and a node 40 direct each signal applied to negative terminals 16 and 20 respectively to a node 42. A resistor R2 is placed intermediate node 38 and node 42 and a resistor R3 is placed intermediate node 40 and node 42. Resistors R2 and R3 provide an electrical summation of the voltage potential differences of negative terminals 16 and 20 to node 42. The summed signal appearing at node 42 is further directed to negative output terminals 33 and 35 respectively of left secondary output LS° and right secondary output RS°. The placement of a node 43 applies equal voltage to negative output terminals 33 and 35 respectively. The electrical summation of the differences through resistors R2 and R3 provides a new reference to ground for left secondary output LS° and right secondary output RS° separate from the reference to ground (not shown) of the signal input. The resulting out of phase signals appearing at left secondary output LS° and right secondary output RS° provide the spatial or ambient sound information to a listener. Resistors R2 and R3 further provide a voltage drop to the signal directed to left secondary output LS° and right secondary output RS° so that the secondary sound information is not as loud as the primary sound information. Resistors R2 and R3 can range in value from 10 to 25 ohms, although in the preferred embodiment, resistors R2 and R3 each have a value of 20 ohms with a power rating of 10 watts. Further to the preferred embodiment, LS° and RS° employ spring loaded terminals for their respective positive and negative leads.

Referring to FIG. 1, left secondary output LS° is connected to a left secondary speaker 44 and right secondary output RS° is connected to a right secondary speaker 46. In the preferred embodiment, left secondary speaker 44 represents left rear speaker and right secondary speaker 46 represents right rear speaker.

Referring to FIG. 2, a node 48, intermediate node 30 and resistor R1, and a node 50, intermediate node 32 and resistor R4, direct the signals appearing at positive terminals 14 and 18 respectively to a node 52. A resistor R5 is placed intermediate node 48 and node 52 and a resistor R6 is placed intermediate node 50 and node 52. Resistors R5 and R6 provide an electrical summation of the voltage potential differences of positive terminals 14 and 18 respectively to node 52. A resistor R11, a first voltage divider, provides a line level reference to ground for a mono center line level output C°. The first voltage divider converts the speaker level signal to 9.9 percent of its original level, resulting in a line level signal for applying to the mono center line level output C°. A node 54 provides a reference to ground to center output C° separate from the input ground (not shown). Resistors R5, R6, and R11 can range in value as long as the resulting 9.9 percent voltage division is achieved. In the preferred embodiment, resistors R5 and R6 have a value of 100 ohms with a power rating of 1 watt, and resistor R11 has a value of 10 ohms with a power rating of ¼ watt. Further to the preferred embodiment, the mono center line level output C° is a female RCA type jack Referring to FIG. 1, center output C° is connected to a center speaker 56 through a center power amplifier 58. The center speaker 56 can be placed according to listener preference, but is must often placed intermediate the left and right front speakers respectively. Separate control of the amplitude of center speaker 56 allows the listener to apply the desired amount of volume to center speaker 56 Considering that all listening environments are different, it is advantageous to have such separate amplitude control of center speaker 56. The prior art devices have not shown to provide adequate signal level to the center speaker. Further, equalization of center speaker 56, separate from the front and rear channels is possible by employing a center power amplifier 58 with equalizational control or by inserting a separate equalization device (not shown) along the signal path intermediate the center output C° and the center power amplifier 58.

Referring to FIG. 2, a node 60 is electrically coupled to the signal being directed to positive terminal 34 of left secondary output LS° , directing the signal through a resistor R7 to a node 62. The signal appearing at node 62 is then directed to a left secondary line level output 68. Accordingly, a node 64 is electrically coupled to the signal being directed to positive terminal 36 of right secondary output RS°, directing the signal through a resistor R10 to a node 66. The signal appearing at node 66 is then directed to a right secondary line level output 70. Resistors R7 and R10 assist in the voltage drop of the respective speaker level signal to a line level signal for applying to left and right secondary line level outputs 68 and 70 respectively. A resistor R8, a second voltage divider, provides a line level reference to ground separate from the input ground (not shown) for the signal applied to left secondary line level output 68. A resistor R9, a third voltage divider, provides a line level reference to ground separate from the input ground (not shown) for the signal applied to right secondary line level output 70.

The second and third voltage dividers convert the speaker level signal to 9.9 percent of its original value, resulting in a line level signal for applying to left and right secondary line level outputs 68 and 70 Further, resistors R7, R8, R9, and R10 provide the necessary resistive pass for LS° and RS°, when no speakers are connected to LS° and RS°, to create center output C°. Resistors R7, R8, R9, and R10 can range in value as long as the resulting 9.9 percent voltage division is achieved In the preferred embodiment, R7 and R10 have a value of 10 ohms, with a power rating of 10 watts, and R8 and R9 have a value of 1 ohm with a power rating of 10 watts. Further to the preferred embodiment, left and right secondary line level outputs 68 and 70 are female RCA type jacks.

Figure 3:
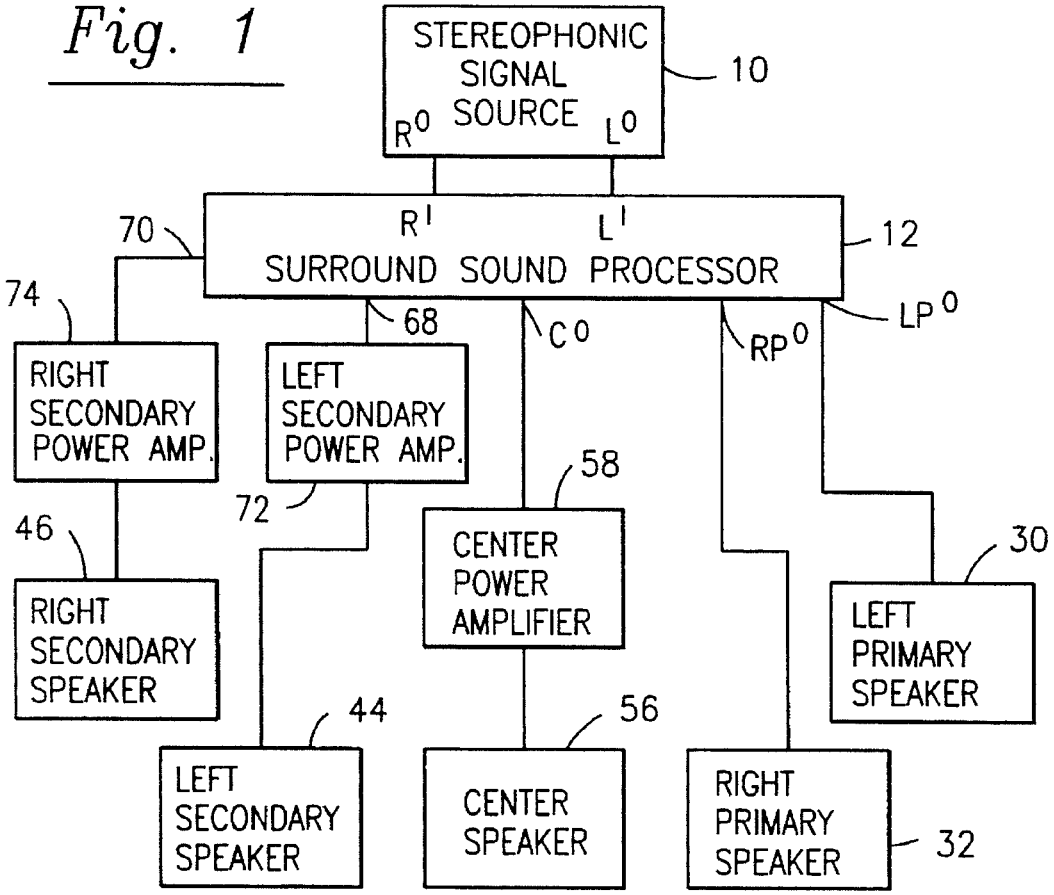
FIG. 3 is a block diagram of an alternate configuration of the multi channel surround sound simulation device of the present invention.

Referring to FIG. 3, left secondary line level output 68 is connected to a left secondary power amplifier 72, and right secondary line level output 70 is connected to a right secondary power amplifier 74. Left and right secondary line level outputs 68 and 70 provide a means for amplifying the secondary speakers 44 and 46 respectively independently of the primary speakers 30 and 32. This means for amplifying the secondary speakers 44 and 46 provides separate amplitude control of the rear speakers from the front speakers. Further, additional equalization of the rear speakers could be performed by tone controls on the amplifiers 72 and 74 or by inserting equalization devices (not shown) along the signal path intermediate left and right secondary line level outputs 68 and 70 and amplifiers 72 and 74 respectively.

Referring to FIG. 2, a first switch S1A is electrically coupled along the signal path directed from terminal 14 to terminal 22, intermediate node 30 and node 48. A second switch S1B is electrically coupled along the signal path directed from terminal 14 to terminal 34, intermediate node 30 and node 60. A third switch S1C is electrically coupled along the signal path directed from terminal 18 to terminal 36, intermediate node 32 and node 64. A fourth switch S1D is electrically coupled along the signal path directed from terminal 18 to terminal 26, intermediate node 32 and node 50. Swtiches S1A, S1B, S1C, and S1D are collectively a gang switch S1, wherein manipulation of gang switch S1 affects all four switches S1A, S1B, S1C, and S1D. Switch S1 is a three position rotary switch having a theater mode, a rear mode, and a front mode.

Positioning gang switch S1 in the front mode passes the signal applied at left input $L^i$ to left primary output LP° through switch S1A and passes the signal applied at right input $R^i$ to right primary output RP° through switch S1D, thereby providing a signal to left and right front speakers 30 and 32 respectively. Additionally the signal passes to center line level output C°, providing a signal to center speaker 56 through center amplifier 58. The open circuit present at switches S1B and S1C when gang switch S1 is in the front mode prohibits the signal from passing to left and right secondary outputs LS° and RS° and left and right secondary line level outputs 68 and 70. Therefore, when gang switch S1 is in the front mode, only the left and right primary outputs LP° and RP° and the center output C° are operable.

Positioning gang switch S1 in the rear mode passes the signal applied at left signal input $L^i$ to left secondary output LS° and to left secondary line level output 68 through switch S1B and passes the signal applied at right signal input $R^i$ to right secondary output RS° and to right secondary line level output 70, thereby providing a signal to the left and right rear speakers 44 and 46 respectively. The open circuit present at switches S1A and S1D when gang switch S1 is in the rear mode prohibits the signal from passing to left and right primary outputs LP° and RP° and to center line level output C°. Therefore, when gang switch S1 is in the rear mode, only the left and right secondary outputs LS° and RS° and the left and right secondary line level outputs 68 and 70 are operable.

Positioning gang switch S1 in the theater mode provides a signal to all outputs of the surround processor 12, wherein all open circuits are eliminated. Switch S1 provides the theater mode to listen to surround sound encoded signal sources. The front and rear modes are provided to allow proper amplitude adjustment and equalization of the respective speakers before listening to a surround sound encoded signal source. Further, the front mode allows listening of a two channel non-surround sound encoded signal source without removing the surround sound processor 12 from a stereo system configuration.

Referring to FIG. 2, a first potentiometer P1A is provided along the signal path directed from terminal 14 to terminal 34, intermediate switch S1B and node 60. A second potentiometer P1B is provided along the signal path directed from terminal 18 to terminal 36, intermediate switch S1C and node 64. A third potentiometer P1C is provided along the summation signal path of terminals 16 and 20, intermediate node 42 and a node 76. Potentiometers P1A, P1B, and P1C are collectively a triple gang potentiometer P1, wherein manipulation of gang potentiometer P1 affects potentimeters P1A, P1B, and P1C identically.

Potentiometer P1 permits amplitude manipulation of left and right secondary outputs LS° and RS°, center output C° and left and right secondary line levels outputs 68 and 70. Accordingly, the volume of rear speakers 44 and 46 and center speaker 56 can be proportionally varied by manipulating gang potentiometer P1. Further changes to the amplitude of center speaker 56 can be achieved by manipulating center amplifier 58. In the preferred embodiment, potentimeters P1A, P1B, and P1C have values of 25 ohms with power ratings of 5 watts.

The preferred embodiment of the present invention is shown in FIG. 2 having the left and right secondary line level outputs 68 and 70 contained within the circuit of the surround sound processor 12. This allows a user of the surround sound processor 12 to upgrade their surround sound system with additional amplifiers, if so desired. The preferred configuration of the present invention is shown in block diagram FIG. 1 wherein amplifier 58 is employed for center speaker 56 Although the left and right secondary line level outputs 68 and 70 are present in the device employed in FIG. 1, they are not being used. Further, if the configuration of FIG. 2 is employed using the left and right secondary line level outputs 68 and 70, left secondary output LS° and right secondary output RS° are not defeated. Simultaneous use of left and right secondary outputs LS° and RS° and left and right secondary line level outputs 68 and 70 is possible with the surround sound processor 12 of the present invention shown in FIG. 2.

Equivalent elements can be substituted for the elements employed in this invention to obtain the same results in the same manner.

Having thus described the invention what is claimed and desired to be secured by Letters Patent is:

1. A passive multi channel surround sound simulation device comprising, input means for receiving a two channel speaker level stereophonic signal, interfacing means for producing from the two channel speaker level stereophonic signal left and right primary speaker level signals, left and right secondary speaker level signals, a mono center speaker level signal, and a surround signal ground separate from an input ground, left and right primary speaker level outputs for connecting the left and right primary speaker level signals to left and right primary loudspeakers, left and right secondary speaker level outputs for connecting the left and right secondary speaker level signals to left and right secondary loudspeakers, the left and right secondary speaker level outputs electrically coupled to the surround signal ground means for converting the mono center speaker level signal to a mono center line level signal, and a mono center line level output for connecting the mono center line level signal to a center loudspeaker through a center power amplifier, the mono center line level output electrically coupled to the surround signal ground.

2. The passive multi channel surround sound simulation device according to claim 1, further comprising, means for converting the left and right secondary speaker level signals to left and right secondary line level signals, and left and right secondary line level outputs for connecting the left and right secondary line level signals alternately to the left and right secondary loudspeakers through left and right secondary power amplifiers, the left and right secondary line level outputs electrically coupled to the surround signal ground.

3. The passive multi channel surround sound simulation device according to claim 2, wherein the input means for receiving the two channel speaker level stereophonic signal are left and right input jacks, the left and right input jack each having a positive and negative terminal, the stereophonic signal originating from a stereophonic signal source, the stereophonic signal source having a left and right signal output, the left signal output of the signal source connected to the left input jack, and the right signal output of the signal source connected to the right input jack.

4. The passive multi channel surround sound simulation device according to claim 3, wherein the interfacing means passes the stereophonic signal appearing at the left input jack to the left primary speaker level output, the stereophonic signal appearing at the right input jack to the right primary speaker level output, the stereophonic signal appearing at the positive terminal of the left input jack to a positive terminal of the left secondary speaker level output, the stereophonic signal appearing at the positive terminal of the right input jack to a positive terminal of the right secondary speaker level output, and a summation of the stereophonic signals appearing at the negative terminals of the input jacks to negative terminals of the left and right secondary speaker level outputs, the summation of the stereophonic signal appearing at the negative terminals of the input jacks creating the surround signal ground separate from the input signal ground.

5. The passive multi channel surround sound simulation device according to claim 4, wherein the means for converting the mono center speaker level signal to a mono center line level signal is a first voltage divider, the first voltage divider reducing the mono center line level signal to about 10% of the mono center speaker level signal.

6. The passive multi channel surround sound simulation device according to claim 5, wherein the mono center line level output is electrically coupled to the surround signal ground.

7. The passive multi channel surround sound simulation device according to claim 4, wherein the means for converting the left and right secondary speaker level signals to left and right secondary line level signals are second and third voltage dividers, the second and third voltage dividers reducing the secondary line level signals to about 10% of the secondary speaker level signals.

8. The passive multi channel surround sound simulation device according to claim 7, wherein the left and right secondary line level signals are electrically coupled to the surround signal ground.

9. A passive multi channel surround sound simulation device comprising, left and right input jacks for receiving a two channel speaker level stereophonic signal, the left and right input jack each having a positive and negative terminal, the stereophonic signal originating from a stereophonic signal source, the stereophonic signal source having a left and right signal output, the left signal output of the signal source connected to the left input jack, and the right signal output of the signal source connected to the right input jack, interfacing means for producing from the two channel speaker level stereophonic signal left and right primary speaker level signals, left and right secondary speaker level signals, a mono center speaker level signal, and a surround signal ground separate from an input ground, left and right primary speaker level outputs for connecting the left and right primary speaker level signals to left and right primary loudspeakers, left and right secondary speaker level outputs for connecting the left and right secondary speaker level signals to left and right secondary loudspeakers, the left and right secondary speaker level outputs electrically coupled to the surround signal ground, means for converting the mono center speaker level signal to a mono center line level signal, a mono center line level output for connecting the mono center line level signal to a center loudspeaker through a center power amplifier, the mono center line level output electrically coupled to the surround signal ground, means for converting the left and right secondary speaker level signals to left and right secondary line level signals, and left and right secondary line level outputs for connecting the left and right secondary line level signals alternately to the left and right secondary loudspeakers through left and right secondary power amplifiers, the left and right secondary line level outputs electrically coupled to the surround signal ground.

10. The passive multi channel surround sound simulation device according to claim 9, wherein the interfacing means passes the stereophonic signal appearing at the left input jack to the left primary speaker level output, the stereophonic signal appearing at the right input jack to the right primary speaker level output, the stereophonic signal appearing at the positive terminal of the left input jack to a positive terminal of the left secondary speaker level output, the stereophonic signal appearing at the positive terminal of the right input jack to a positive terminal of the right secondary speaker level output, and a summation of the stereophonic signal appearing at the negative terminals of the input jacks to negative terminals of the left and right secondary speaker level outputs, the summation of the stereophonic signals appearing at the negative terminals of the input jacks creating the surround signal ground separate from the input signal ground.

11. The passive multi channel surround sound simulation device according to claim 10, wherein the interfacing means is an electronic circuit.

12. The passive multi channel surround sound simulation device according to claim 9, wherein the means for converting the mono center speaker level signal to a mono center line level signal is a first voltage divider, the first voltage divider reducing the mono center line level signal to about 10% of the mono center speaker level signal.

13. The passive multi channel surround sound simulation device according to claim 9, wherein the means for converting the left and right secondary speaker level signals to left and right secondary line level signals are second and third voltage dividers, the second and third voltage dividers reducing the secondary line level signals to about 10% of the secondary speaker level signals.

14. A passive multi channel surround sound simulation device comprising, left and right input jacks for receiving a two channel speaker level stereophonic signal, the left and right input jack each having a positive and negative terminal, the stereophonic signal originating from a stereophonic signal source, the stereophonic signal source having a left and right signal output, the left signal output of the signal source connected to the left input jack, and the right signal output of the signal source connected to the right input jack, an electronic circuit for producing from the two channel speaker level stereophonic signal left and right primary speaker level signals, left and right secondary speaker level signals, a mono center line level signal, left and right secondary line level outputs, and a surround signal ground separate from an input ground, left and right primary speaker level outputs for connecting the left and right primary speaker level signals to left and right primary loudspeakers, left and right secondary speaker level outputs for connecting the left and right secondary speaker level signals to left and right secondary loudspeakers, the left and right secondary speaker level outputs electrically coupled to the surround signal ground, a mono center line level output for connecting the mono center line level signal to a center loudspeaker through a center power amplifier, the mono center line level output electrically coupled to the surround signal ground, left and right secondary line level outputs for connecting the left and right secondary line level signals alternately to the left and right secondary loudspeakers through left and right secondary power amplifiers, the left and right secondary line level outputs electrically coupled to the surround signal ground, a three position gang switch electrically coupled to the circuit for alternately routing the stereophonic signal, a first position to the primary and center outputs, a second position to the secondary outputs, and a third position to the primary, center, and secondary outputs, a triple gang potentiometer electrically coupled to the circuit for adjusting an output level to the secondary and center outputs, the gang potentiometer electrically coupled to the circuit such that adjustments to the gang potentiometer provide relative changes to the output level of the secondary and center outputs.

15. The passive multi channel surround sound simulation device according to claim 14, wherein the electronic circuit passes the stereophonic signal appearing at the left input jack to the left primary speaker level output, the stereophonic signal appearing at the right input jack to the right primary speaker level output, the stereophonic signal appearing at the positive terminal of the left input jack to a positive terminal of the left secondary speaker level output, the stereophonic signal appearing at the positive terminal of the right input jack to a positive terminal of the right secondary speaker level output, a summation of the stereophonic signals appearing at the negative terminals of the input jacks to negative terminals of the left and right secondary speaker level outputs, a combination of the stereophonic signal appearing at the positive terminals of the input jacks to a positive terminal of the mono center line level output electrically coupled to a first voltage divider, the summation of the stereophonic signal appearing at the negative terminals of the input jacks to a negative terminal of the mono center line level output electrically coupled to the first voltage divider, the stereophonic signal appearing at the positive terminal of the left input jack to a positive terminal of the left secondary line level output electrically coupled to the second voltage divider, the stereophonic signal appearing at the positive terminal of the right input jack to a positive terminal of the right secondary line level output electrically coupled to the third voltage divider, the summation of the stereophonic signal appearing at the negative terminals of the input Jacks to negative terminals of the left and right secondary line level outputs, the negative terminal of the left secondary line level output electrically coupled to the second voltage divider, the negative terminal of the right secondary line level output electrically coupled to the third voltage divider, the summation of the stereophonic signal appearing at the negative terminals of the input jacks creating the surround signal ground separate from the input signal ground.

16. The passive multi channel surround sound simulation device according to claim 14, wherein an output level appearing at the mono center line level output is about 10% of an output level appearing at the left and right primary speaker level outputs.

17. The passive multi channel surround sound simulation device according to claim 14, wherein an output level appearing at the left and right secondary line level outputs is about 10% of an output appearing at the left and right primary speaker level outputs.

18. The passive multi channel surround sound simulation device according to claim 14, wherein the left and right primary loudspeakers are left and right front loudspeakers.

19. The passive multi channel surround sound simulation device according to claim 14, wherein the left and right secondary loudspeakers are left and right rear loudspeakers.

20. The passive multi channel surround sound simulation device according to claim 14, wherein the center loudspeaker is placed intermediate the left and right front loudspeakers.

* * * * *